US010932991B2

(12) United States Patent
Tong

(10) Patent No.: US 10,932,991 B2
(45) Date of Patent: Mar. 2, 2021

(54) FEEDING BOTTLE

(71) Applicant: WONG HAU PLASTIC WORKS & TRADING CO., LTD., Kowloon (HK)

(72) Inventor: Sau Chai Henry Tong, Kowloon (HK)

(73) Assignee: WONG HAU PLASTIC WORKS & TRADING CO., LTD., Kowloon (HK)

( * ) Notice: Subject to any disclaimer, the term of this patent is extended or adjusted under 35 U.S.C. 154(b) by 243 days.

(21) Appl. No.: 16/119,257

(22) Filed: Aug. 31, 2018

(65) Prior Publication Data

US 2020/0069528 A1 Mar. 5, 2020

(51) Int. Cl.

| | |
|---|---|
| ***A61J 9/04*** | (2006.01) |
| ***A61J 9/00*** | (2006.01) |
| ***A61J 11/00*** | (2006.01) |
| ***A61J 11/04*** | (2006.01) |

(52) U.S. Cl.

CPC ..... *A61J 9/04* (2013.01); *A61J 9/005* (2013.01); *A61J 11/008* (2013.01); *A61J 11/04* (2013.01)

(58) Field of Classification Search

CPC ..... A61J 9/0684; A61J 11/008; A61J 11/04; A61J 9/0669; A61J 9/0623; A61J 17/02; A61J 9/04; A61J 9/001; A61J 11/02; A47G 19/2272; A47G 65/13; B65D 45/325; B65D 47/06; B65D 47/2031; B65D 51/1605

USPC ..... 215/11.5, 370, 11.6, 343, 260, 341; 220/628, 500; 65/13; 446/71

See application file for complete search history.

(56) References Cited

U.S. PATENT DOCUMENTS

| | | | | |
|---|---|---|---|---|
| 2,321,236 A * | 6/1943 | Parkin | A61J 9/04 137/860 |
| 5,699,921 A * | 12/1997 | Rodriguez | A61J 9/04 215/11.5 |
| 7,337,915 B1 * | 3/2008 | Weldon | A47G 23/0225 220/483 |
| 8,763,828 B2 * | 7/2014 | Dunn | A61J 9/04 215/11.5 |
| 2006/0037927 A1 * | 2/2006 | Williams | A61J 11/04 215/11.1 |
| 2009/0039047 A1 * | 2/2009 | Shtalryd | A61J 9/04 215/11.5 |
| 2009/0314734 A1 * | 12/2009 | Pfenniger | A61J 11/04 215/11.1 |

(Continued)

*Primary Examiner* — J. Gregory Pickett
*Assistant Examiner* — Tia Cox
(74) *Attorney, Agent, or Firm* — Muncy, Geissler, Olds & Lowe, P.C.

(57) ABSTRACT

The present application relates to the technical field of baby appliance structure, and provides a feeding bottle, including: a body and at least one non-return valve integrally formed at a lower of the body. The non-return valve includes a connection portion that is connected at the body, an extension portion for disturbing the laminar flow state of the internal liquid of the body when shaking the body, and a valve for allowing only the air outside to enter into the body, the extension portion is tapered and extends along a surface of the body toward the interior of the body, the extension portion is located at the inside of the bottom of the body, or located above the inside of the bottom of the body and in the vicinity of the inside of the bottom of the body. This design can solve the problem that the structure of the existing feeding bottle may cause flatulence to the baby due to the unbalanced pressure and may easily lead to incomplete dissolution of the milk powder.

7 Claims, 4 Drawing Sheets

(56) References Cited

U.S. PATENT DOCUMENTS

| | | | | |
|---|---|---|---|---|
| 2011/0180508 | A1* | 7/2011 | Fong | A61J 9/04 215/11.5 |
| 2013/0327737 | A1* | 12/2013 | Lee | A61J 9/04 215/11.5 |
| 2014/0374372 | A1* | 12/2014 | Itzek | A61J 9/04 215/11.6 |
| 2015/0231035 | A1* | 8/2015 | Berkovitch | A61J 9/04 215/11.5 |
| 2015/0335533 | A1* | 11/2015 | Pineda | A61J 9/00 215/11.1 |
| 2018/0208389 | A1* | 7/2018 | Dowd | A47G 19/2272 |

* cited by examiner

FEEDING BOTTLE

TECHNICAL FIELD

The present application relates to the technical field of baby appliance structure, and more particularly to a feeding bottle.

BACKGROUND

A feeding bottle is a tool for babies to drink water and drink milk. The present feeding bottles uses a closed structure, leaving only a small hole at a nipple of the feeding bottle for the liquid to pass through. However, when using the feeding bottle to feed the baby, with the liquid being sucked by the baby, an internal pressure of the feeding bottle is continuously decreased, thus the liquid in the feeding bottle becomes harder to be sucked out, and the baby naturally increases force to suck. In general, it is required to pull the nipple out of the baby's mouth so that the air enters the feeding bottle to balance the atmospheric pressure. The above problems not only make the feeding troublesome, but also make naturally increase force to suck when the liquid is difficult to be sucked out, so that it is easy to simultaneously inhale the air, which may cause the baby flatulence after a long time use of such kind of feeding bottle. In addition, it is generally needed to shake the feeding bottle when milk powder is being dissolved in the water, which may cause a large amount of foam in the feeding bottle; it is harmful to feed the baby, while the insufficient shaking will cause the incomplete dissolution of the milk powder in the water.

SUMMARY

An object of the present application is to provide a feeding bottle in order to solve the problem that pressure of the existing feeding bottle may cause flatulence to the baby due to the unbalanced pressure and may easily lead to incomplete dissolution of the milk powder.

The present application is solved in this way: a feeding bottle, comprising: a body and at least one non-return valve integrally formed at a lower of the body, the non-return valve comprises a connection portion that is connected at the body, a extension portion for disturbing the laminar flow state of the internal liquid of the body when shaking the body, and a valve for allowing only the air outside to enter into the body, the extension portion is tapered and extended along a surface of the body toward the interior of the body, the extension portion is located at the inside of the bottom of the body, or located above the inside of the bottom of the body and close to the internal side of the bottom of the body.

Further, the number of the non-return valves is multiple, and a plurality of the non-return valves is arranged in a circle evenly at the body.

Further, the area of a longitudinal sectional area of the extension portion decreases along its extending direction, and the longitudinal sectional area of the extension portion is elliptical.

Further, the extension portion is tubular, the valve is connected in the extension portion, and the valve opens when the pressure inside the body is far less than the pressure outside the body.

Further, the feeding bottle is further comprises a nipple assembly detachably connected to the top of the body, and an suction member integrally formed at a bottom of the body for fixing the body.

Further, a top end of the body is further extended a connection unit for connecting the nipple assembly; the nipple assembly comprises a annular connection member that is restrictedly connected to the connection unit, a cover for cooperating with the annular connection member in a clipping manner, and a nipple member that is restrictedly connected between the annular connection member and the cover.

Further, a first sliding engager is further disposed at an outer surface of the annular connection member, a second sliding engager is disposed at an inner surface of the cover, the first sliding engager and the second sliding engager are locked when moves toward each other, and unlocked when moves oppose each other.

Further, the first sliding engager comprises a first columnar member that is obliquely disposed at the outer surface of the annular connection member, and a protrusion that is disposed at a lower surface of the first columnar member, the second sliding engager comprises a second columnar member with a same oblique angle as the first columnar member, a bend member that is bent close to the inner surface of the cover, and a notch that is disposed at a upper surface of the second columnar member, when the first sliding engager is moving toward the second sliding engager, the lower surface of the first columnar member is closed to the upper surface of the second columnar member, and when an end of the first columnar member is abutted against the bend member, the protrusion is positioned at the notch.

Further, the protrusion is hemispherical, or a lower surface of the protrusion is arc-shaped, and the notch is a circular-arc-shaped notch.

Further, the feeding bottle is a long cylindrical container made of elastic flexible plastic or silicone material.

Compared to the prior art, the feeding bottle of the present application has the following beneficial effects: by arranging non-return valve(s) at the bottom of the body, when a baby is fed, the non-return valve can be used to balance the atmospheric pressure inside and outside of the body, thereby avoiding the problem of flatulence when the baby is fed. In the meanwhile, the non-return valve comprises the extension portion extending along the surface of the body toward the interior of the body, the extension portion is tapered, and the extension portion is located at the bottom of the body or in the vicinity of the bottom of the body, thus when shaking the body, the extension portion can avoid the laminar flow of the liquid inside the feeding bottle, thereby accelerating the dissolution of the milk powder and preventing the milk powder from agglomerating at the bottom of the bottle.

BRIEF DESCRIPTION OF THE DRAWINGS

In order to make the technical solutions in the embodiments of the present application clearer, the accompanying drawings to be used in the embodiments and the description of the prior art will be briefly introduced below, it is apparent that the drawings in the following description are merely some embodiments of the present application and that other drawings may be obtained by those skilled in the field without departing from the inventive nature of the present application.

Figure 1:
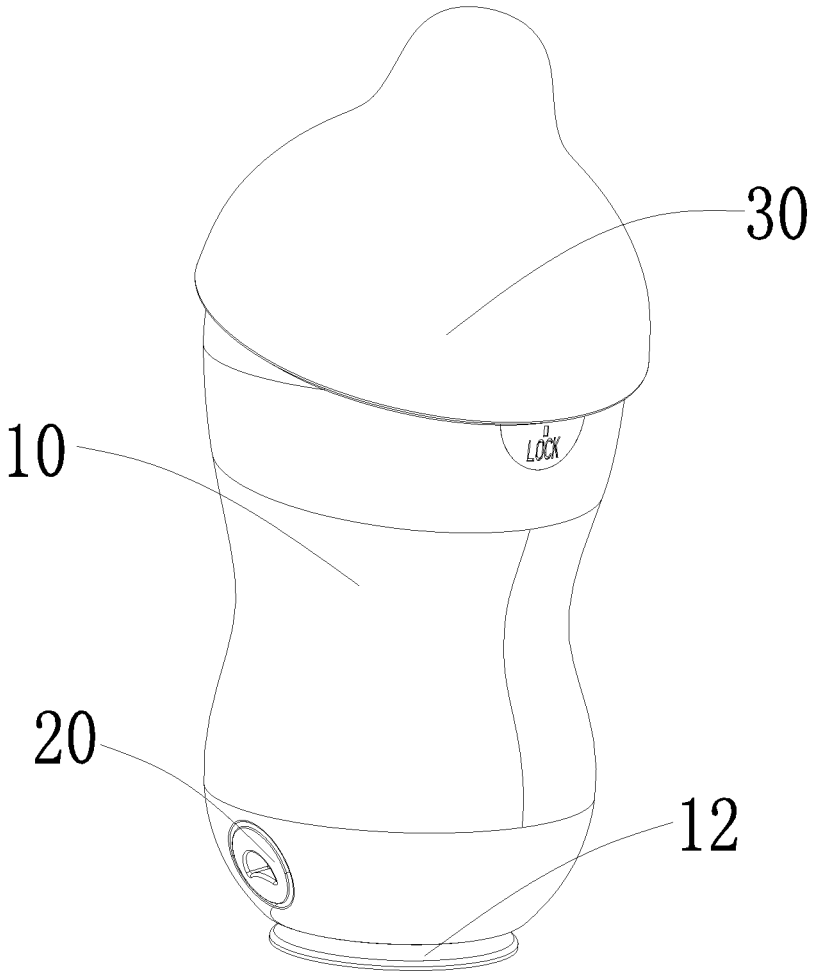
FIG. 1 is an integral structure view of a feeding bottle provided by an embodiment of the present application.

Wherein, body 10, connection unit 11, absorption member 12, non-return valve 20, connection portion 21, extension portion 22, valve 23, nipple assembly 30, annular connection member 31, first sliding engager 311, first columnar member 3111, protrusion 3112, cover 32, perforation 321, second sliding engager 322, second columnar member 3221, bend member 3222, notch 3223, nipple member 33, annular screwed groove 331, protection cover 34.

DETAILED DESCRIPTION OF THE EMBODIMENTS

In order to make the technical problems to be solved, technical solutions, and beneficial effects of the present application clearer and more understandable, the present application will be further described in detail hereinafter with reference to the accompanying drawings and embodiments. It should be understood that the embodiments described herein are only intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component.

It should be understood that, "length", "width", "upper", "lower", "front", "back", "left" and "right", "vertical", "horizontal", "top", "bottom", "inside", "outside" and other terms indicating the orientation or positional relationship are based on orientation or positional relationship shown in the drawings, and are only for the purpose of facilitating the description of the application and simplifying the description, instead of indicating or implying that the indicated device or component must have a specific orientation and constructed and operated in a particular orientation, and therefore it cannot be construed as limitation of the application.

In addition, the terms "first" and "second" are for illustrative purposes only and should not be construed as indicating or implying a relative importance or implicitly indicating the quantity of technical features indicated. Therefore, a feature that defines "first" and "second" may expressly or implicitly include one or more of the features. In the description of the present application, "multiple" means two or more than two, unless otherwise specifically defined.

Please refer to FIGS. 1 to 4, in an embodiment of the present application provides a feeding bottle, which comprises: a body 10 and at least one non-return valve 20 integrally formed at a lower portion of the body 10. The diameter of an upper portion and the diameter of a lower portion of the body 10 are larger than the diameter of a middle portion of the body 10, so as to facilitate the grip during use. The non-return valve 20 is preferably used for ensuring that the air outside the body 10 can enter the body 10 under a certain pressure, while the liquid and the air inside the body 10 cannot flow out of the body 10. The non-return valve 20 comprises: a connection portion 21 connected to the body 10, an extension portion 22 extending along a surface of the body 10 toward an inner side of the body 10, and a valve 23 for only allowing air outside the body 10 to enter the body 10. The extension portion 22 is preferably tapered, and when shaking the feeding bottle containing a liquid clockwise or counterclockwise according to a common method to mix the milk powder, the extension portion 22 can be used to disturb the laminar flow in the body 10 to accelerate the milk powder mixing process. The extension portion 22 is located at the inner side of the bottom of the body 10, or located above the inner side of the bottom of the body 10 and in the vicinity of the inner side of the bottom of the body 10, this design is used to ensure that the extension portion 22 can disturb the laminar flow of the liquid when the body 10 is shaken, thereby accelerating the dissolution of milk powder.

In the feeding bottle of the above designed, by arranging non-return valve(s) 20 at the bottom of the body 10, and when a baby is fed, the non-return valve 20 can be used to balance the inside and outside atmospheric pressure of the body 10, thereby avoiding the problem of flatulence when the baby feeds. While the non-return valve 20 comprises a extension portion 22 extends along a surface of the body toward the interior of the body 10, the extension portion 22 is tapered, and the extension portion 22 is located at the bottom of the body 10 or in the vicinity of the bottom of the body 10, thus, when shaking the body 10, the extension portion 22 can avoid the laminar flow of the liquid in the feeding bottle, which can accelerate the dissolution of the milk powder and prevent the milk powder from agglomerating at the bottom of the bottle.

Specifically, in the embodiment of the present application, the number of the non-return valves 20 is multiple, and the plurality of the non-return valves 20 are evenly and annularly arranged on the body.

In this embodiment, the number of the non-return valve 20 may be one, two, three, or more than three. Which is selected according to the diameter of the body 10 and is ensured to be not excess which may otherwise increase the difficulty in cleaning the body 10. And a plurality of the non-return valves 20 are arranged in a evenly circle at the body, herein the non-return valves 20 are preferably at a same circle or at different circles.

Figure 3:
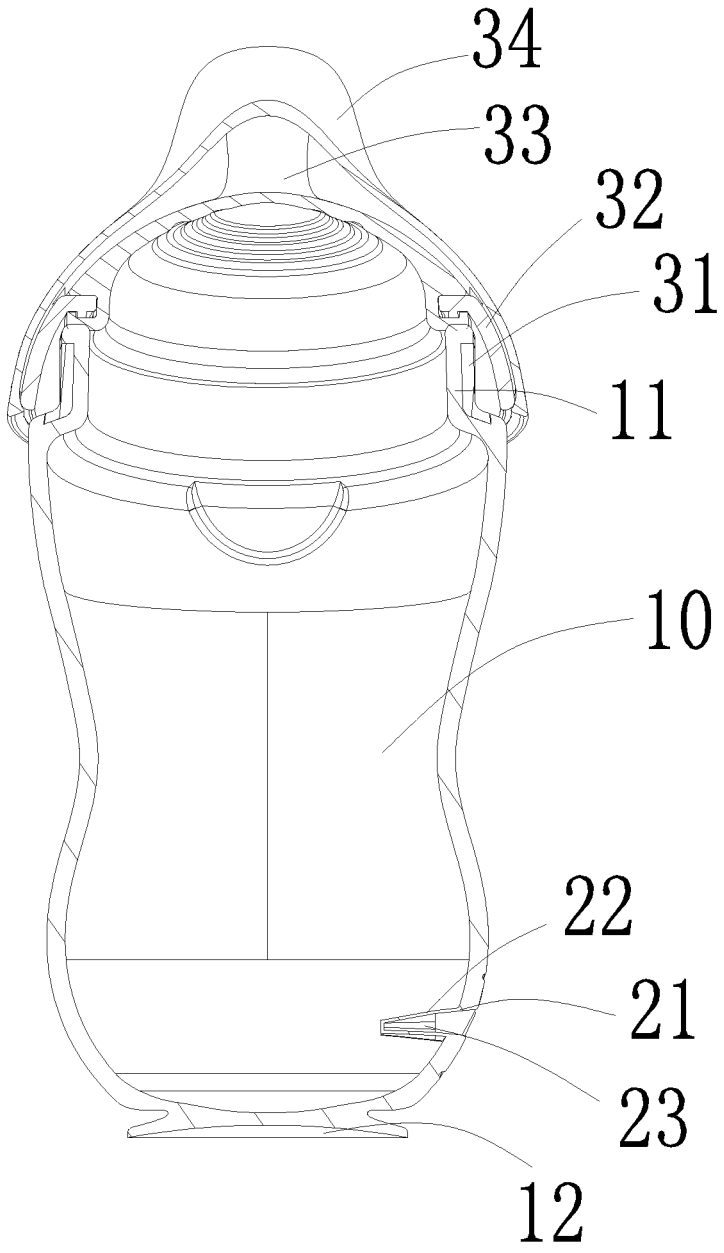
FIG. 3 is a half sectional view of a feeding bottle provided by an embodiment of the present application.

Specifically, as shown in FIG. 3, in the embodiment of the present application, the area of a longitudinal sectional area of the extension portion 22 decreases along its extending direction, and the longitudinal sectional area of the extension portion 22 is elliptical. That is, the area of the longitudinal sectional area of the extending portion 22 gradually decreases from the end in the vicinity of the inner wall of the body 10 toward the other end, and the outer surface of the extending portion 22 is in smooth transition. Besides, the longitudinal sectional area of the extension portion 22 is elliptical, therefore the resistance that occurs from the extending portion 22 is increased when the liquid flows, thereby ensuring turbulent flow without the occurrence of large liquid fluctuations, and preventing the laminar flow from being appeared or without bubbles in the liquid.

Specifically, as shown in FIG. 3, in the embodiment of the present application, the extension portion 22 is preferably a tubular structure, the valve 23 is connected in the extension portion 22, and the valve 23 opens when the pressure inside the body 10 is much smaller than the pressure outside the body 10. Herein, an internal pressure is much smaller than an external pressure is used to ensure the effectiveness of the non-return valves 20 and prevent the liquid in the body 10 from flowing out via the non-return valves 20; it is noted that, in the present embodiment, the internal pressure may be 0.7 times, 0.6 times, or 0.5 times or the like to the external pressure of the body 10, which is not exhaustive.

Figure 2:
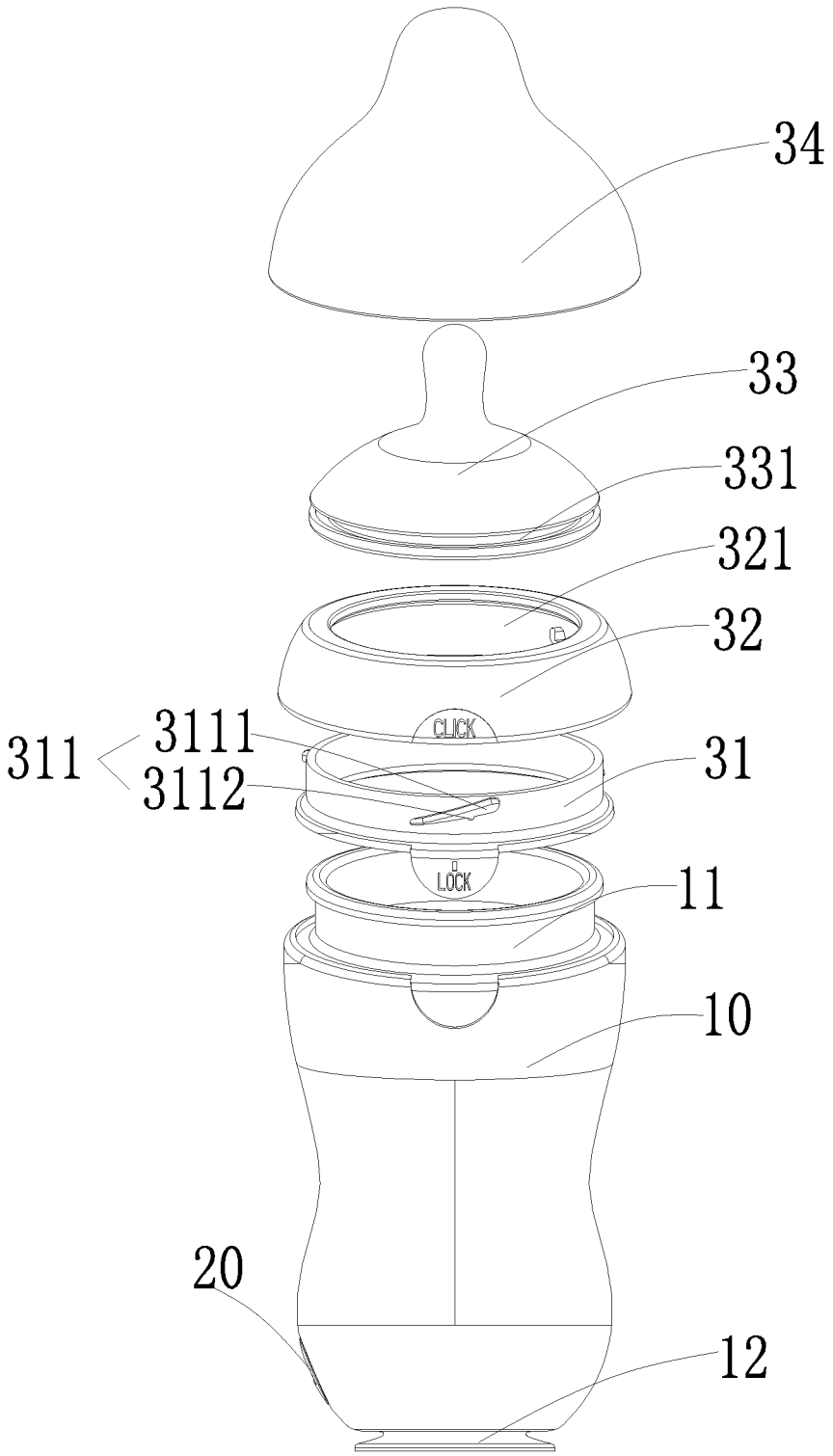
FIG. 2 is an exploded view of a feeding bottle provided by an embodiment of the present application.

Specifically, as shown in FIGS. 1 to 3, in the embodiment of the present application, the feeding bottle further comprises a nipple assembly 30 detachably connected to the top of the body 10, and an suction member 12 integrally formed at the bottom of the body 10 for fixing the body 10. The suction member 12 is preferably a trumpet-shaped sucker, and the sucker has an opening extending outward. This design can facilitate the adsorption and fixation of the body 10 on a desktop or other flat places.

Specifically, as shown in FIGS. 2 and 3, in the embodiment of the present application, a top end of the body 10 is further extends upwards to form a connection unit 11 for connecting the nipple assembly 30; the nipple assembly 30 comprises: a annular connection member 31 that is restrictedly connected to the connection unit 11, a cover 32 for cooperating with the annular connection member 31 in a clipping manner, and a nipple member 33 that is restrictedly connected between the annular connection member 31 and the cover 32.

In this embodiment, the connection unit 11 is preferably an annular structure, and an outer surface of the connection unit 11 is H-shaped, the annular connection member 31 is sleeved at the outer surface of the connection unit 11, and then the cover 32 is covered at the outer surface of the annular connection member 31. The nipple member 33 is an inverted funnel-shaped structure connected at an upper part of the body 10, and a lower end of the nipple member 33 is restrictedly connected between the annular connection member 31 and the cover 32, which can achieve the closure between the nipple member 33 and the body 10 and prevent the nipple member 33 from falling off. In addition, the cover 32 is further provided with a perforation 321, an annular screwed groove 331 is arranged at a lower of the nipple member 33 for clipping at a periphery of the perforation 321, and by threaded connection between the annular screwed groove 331 and the inner surface of the perforation 321, an effective connection between the cover 32 and the nipple member 33 can be achieved. In this embodiment, the cover 32 can also be connected with a protection cover 34 for protecting the nipple member 33.

Figure 4:
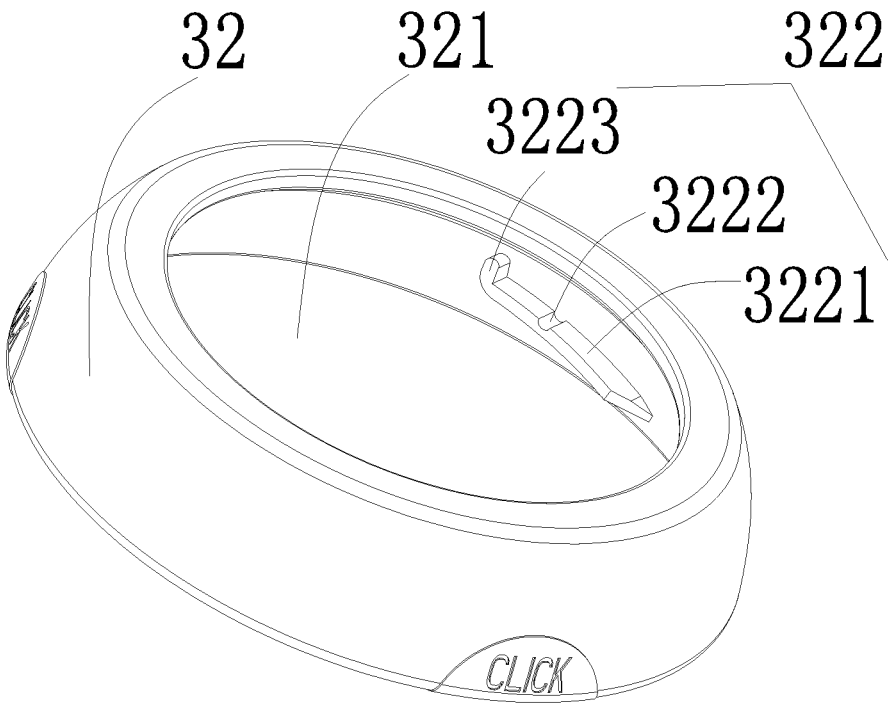
FIG. 4 is a structure view of a cover of a feeding bottle provided by an embodiment of the present application.

Specifically, as shown in FIGS. 2 and 4, in the embodiment of the present application, a first sliding engager 311 is further disposed at an outer surface of the annular connection member 31, a second sliding engager 322 is disposed at an inner surface of the cover 32, the first sliding engager 311 and the second sliding engager 322 are locked when moving toward each other, and unlocked when moving away from each other. This design achieves the detachment and connection between the nipple assembly 30 and the body 10.

Specifically, as shown in FIGS. 2 and 4, in the embodiment of the present application, the first sliding engager 311 comprises a first columnar member 3111 that is obliquely disposed at the outer surface of the annular connection member 31, and a protrusion 3112 that is disposed at a lower surface of the first columnar member 3111. the second sliding engager 322 comprises: a second columnar member 3221 with a same oblique angle as the first columnar member 3111, a bend member 3222 disposed at one end of the second columnar member 3221 and bent along the inner surface of the cover 32, and a notch 3223 that is disposed at an upper surface of the second columnar member 3221. When the first sliding engager 311 moves toward the second sliding engager 322, the lower surface of the first columnar member 3111 contacts with the upper surface of the second columnar member 3221, and when an end of the first columnar member 3111 is abutted against the bend member 3222, the protrusion 3112 is positioned at the notch 3223.

In this embodiment, both the first columnar member 3111 and the second columnar member 3221 are inclined relative to an axis direction of the body 10, that is to say, an angle between the first columnar member 3111 and the axis of the body 10 is equal to an angle between the second columnar member 3221 and the axis of the body 10. When the cover 32 rotates relative to the annular connection member 31 under an external force, the first sliding engager 311 is driven to move relative to the second sliding engager 322 so that the connection and detachment between the cover 32 and the annular connection member 31 are realized. And this type of connection is easier than traditional threaded connection.

Specifically, as shown in FIGS. 2 and 4, in the embodiment of the present application, the protrusion 3223 is hemispherical, or a lower surface of the protrusion 3223 is arc-shaped, and the notch 3223 is a circular-arc-shaped notch. This design can ensure the connection and detachment between the protrusion 3112 and the notch 3223 more easy.

Specifically, in the embodiment of the present application, the feeding bottle is preferably a long cylindrical container made of elastic flexible plastic or silicone material.

The aforementioned embodiments are only preferred embodiments of the present application, and are not intended to limit the present application. Any modification, equivalent replacement, improvement, and so on, which are made within the spirit and the principle of the present application, should be comprised in the scope of the present application.

The invention claimed is:

1. A feeding bottle, wherein the feeding bottle comprises: a body and at least one non-return valve integrally formed at a lower portion of the body; the non-return valve comprises: a connection portion that is connected at the body, an extension portion for disturbing a laminar flow state of a liquid inside the body when shaking the body, and a valve only allowing air outside the body to enter the body; the extension portion is tapered and extends along a surface of the body toward an interior of the body, the extension portion is located at an inner side of the bottom of the body, or alternatively located above and adjacent to the inner side of the bottom of the body, wherein the feeding bottle further comprises a nipple assembly detachably connected to an upper portion of the body, and a suction member integrally formed at the bottom of the body for fixing the body;

wherein a connection unit is extended from a top end of the body for connecting with the nipple assembly; and the nipple assembly comprises an annular connection member that is restrictedly connected to the connection unit, a cover for cooperating engaged with the annular connection member, and a nipple member that is restrictedly connected between the annular connection member and the cover;

wherein a first sliding engager is further disposed at an outer surface of the annular connection member, a second sliding engager is further disposed at an inner surface of the cover, the first sliding engager and the second sliding engager are locked when moving toward each other, and unlocked when moving away from each other.

2. The feeding bottle of claim 1, wherein there are a plurality of the non-return valves, and the plurality of the non-return valves is evenly and annularly arranged on the body.

3. The feeding bottle of claim 1, wherein an area of a longitudinal sectional area of the extension portion decreases along its extending direction, and the longitudinal sectional area of the extension portion is elliptical.

4. The feeding bottle of claim 1, wherein the extension portion is tubular, the valve is connected inside the extension portion, and the valve is opened when a pressure inside the body is far less than an air pressure outside the body.

5. The feeding bottle of claim 1, wherein the first sliding engager comprises a first columnar member that is obliquely disposed at the outer surface of the annular connection member, and a protrusion disposed at a lower surface of the first columnar member; the second sliding engager comprises a second columnar member with a same oblique angle as the first columnar member, a bend member bent at an end of the second columnar member along the inner surface of the cover, and a notch disposed at an upper surface of the second columnar member; when the first sliding engager moves toward the second sliding engager, the lower surface of the first columnar member contacts with the upper surface of the second columnar member, and when an end of the first columnar member is abutted against the bend member, the protrusion is positioned in the notch.

6. The feeding bottle of claim 5, wherein the protrusion is in hemispherical shape, or alternatively a lower surface of the protrusion is arc-shaped, and the notch is a circular-arc-shaped notch.

7. The feeding bottle of claim 1, wherein the feeding bottle is a long cylindrical container made of elastic flexible plastic or silicone material.

* * * * *